US005778574A

United States Patent [19]

Reuben

[11] Patent Number: 5,778,574

[45] Date of Patent: Jul. 14, 1998

[54] AUDIBLE PRODUCT MERCHANDISING TAG

[76] Inventor: Ronnie Reuben, 8355 Labarre, Montreal, Quebec, Canada, H4P 2S5

[21] Appl. No.: 647,835

[22] Filed: May 15, 1996

[51] Int. Cl.[6] ..... G09F 1/00

[52] U.S. Cl. ..... 40/124.03; 40/124.11

[58] Field of Search ..... 40/124.1, 124.03, 40/124.11, 124.12, 124.13, 124.14, 124.16, 594

[56] References Cited

U.S. PATENT DOCUMENTS

| | | | |
|---|---|---|---|
| 3,798,806 | 3/1974 | Sanford | 40/124.1 X |
| 4,810,544 | 3/1989 | Hickman | 40/661 X |
| 4,826,211 | 5/1989 | Sinnott et al. | 40/299 X |
| 4,921,094 | 5/1990 | van den Akker | 40/124.11 |
| 5,063,698 | 11/1991 | Johnson et al. | 40/124.1 |
| 5,135,157 | 8/1992 | Cruz | 40/124.1 X |
| 5,275,285 | 1/1994 | Clegg | 40/124.1 X |
| 5,387,108 | 2/1995 | Crowell | 40/124.1 X |
| 5,568,210 | 10/1996 | Kiehne | 40/701 X |
| 5,611,161 | 3/1997 | Murphy | 40/124.08 |

*Primary Examiner*—Kenneth J. Dorner
*Assistant Examiner*—Andrea Chop
*Attorney, Agent, or Firm*—Swabey Ogilvy Renault; Guy J. Houle

[57] ABSTRACT

An audible product information tag comprised of a pair of panels folded one over the other along a fold line. An electronic program circuit is located in a housing secured to an inner face of one of the panels. A switch actuator is connected at one end to an inner face of the other of the panels and has a switch contact operating connection at an opposed end to enable and disable the electronic programmed circuit. A speaker is connected to the programmed circuit for transmitting an audible message when a switch contact is enabled by the switch actuator upon displacement of the other of the panels a predetermined distance away from the other panel towards an open position. A detachable connection is provided to maintain the panels folded one over the other to a closed position with the switch contact disabled.

3 Claims, 2 Drawing Sheets

Fig. 5
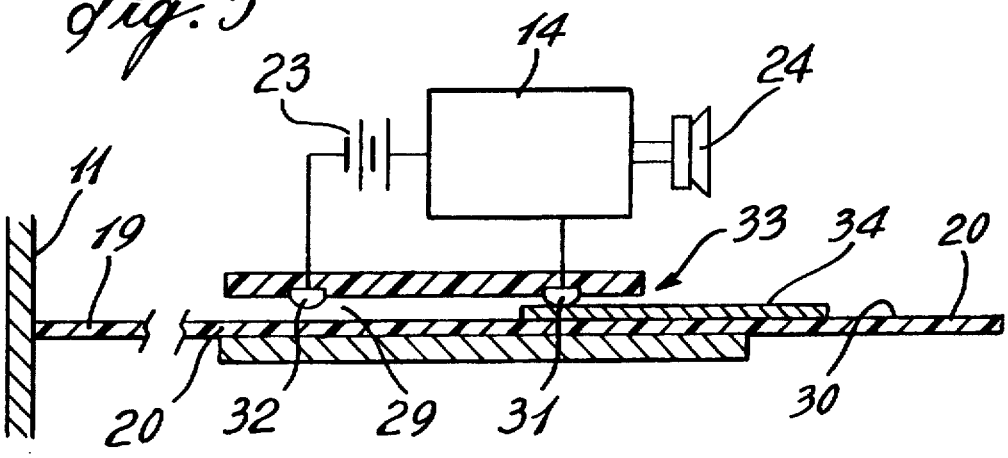
Fig. 6
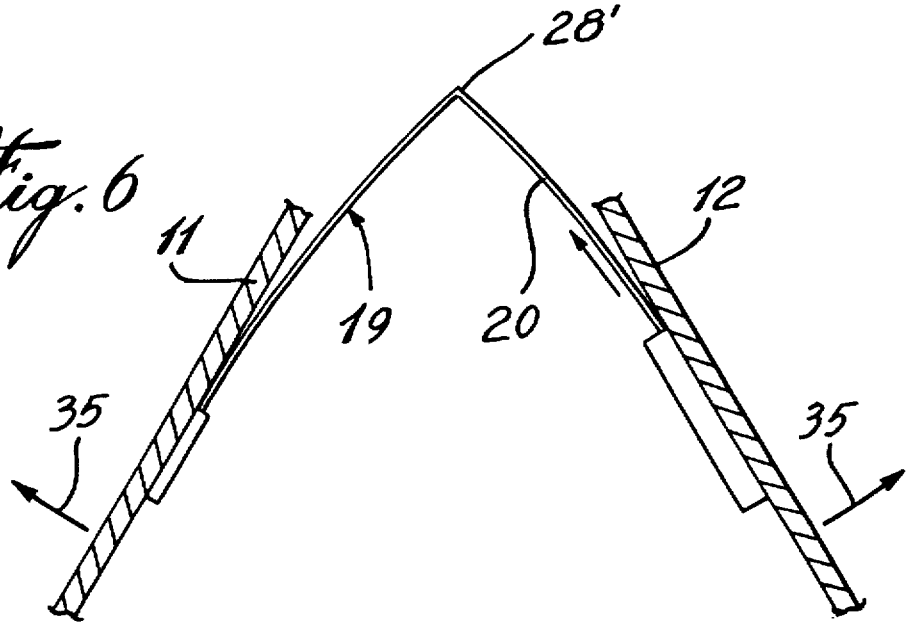
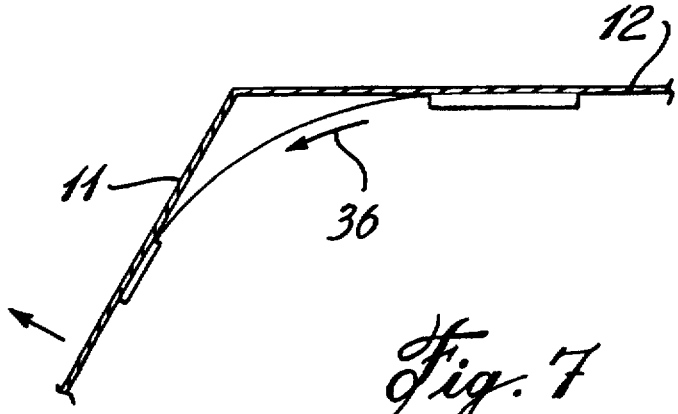
Fig. 7

AUDIBLE PRODUCT MERCHANDISING TAG

TECHNICAL FIELD

The present invention relates to an audible product merchandising tag which is comprised essentially of a card having a pair of panels folded one over the other and when the card is opened to a predetermined position an electronic program circuit is actuated to transmit information about the product to which the tag is secured.

BACKGROUND ART

It is required today when merchandising products to provide certain information about the products construction, assembly instructions or warnings whereby the consumer is made aware of certain important information about the product to be purchased. Some of this information often contains complex words that clerks working in department stores fail to comprehend, such as various new fiber fabrics or technical electronic terms. Furthermore, in today's mass merchandising concept, very few clerks are available to explain to the many consumers various characteristics or features of the multitude of products being offered for sale. Accordingly, we rely on information tags to provide such information to the consumer. This, of course, leads to various other problems in that insufficient information is provided as otherwise the tags would become too large and contain too much printed matter and this would discourage the consumer from reading the tags. Also, with certain new products, the information contained on the tags may discourage a consumer to buy the product due to misunderstandings or lack of information or understanding about the product.

SUMMARY OF INVENTION

It is therefore a feature of the present invention to provide an audible product information tag and wherein messages about the product are audibly transmitted.

According to a further broad aspect of the present invention there is provided an audible product information tag comprised of a pair of panels folded along a fold line and when the panels are separated a predetermined distance, an electronic program circuit is actuated to transmit an audible message to the person that has actuated the tag.

Another feature of the present invention is to provide an audible product information tag capable of providing both textual and audible messages about a product.

Another feature of the present invention is to provide an audible product information tag which is used as a marketing tool to sell a product to which the tag is attached.

According to the above features, from a broad aspect, the present invention provides an audible product information tag comprising a pair of panels folded one over the other along a fold line. An electronic program circuit is located in a housing secured to an inner face of one of the panels. Switch actuation means is connected at one end to an inner face of the other of the panels and has a switch contact operating means at an opposed end for enabling and disabling the electronic program circuit. Audible speaker means is provided for transmitting an audible message when a switch contact of a switch is enabled by the switch actuation means upon displacement of the other of the panels a predetermined distance away from the one of the said panels towards an open position.

According to a still further broad aspect, an engageable detachment means is also provided to maintain the panels folded one over the other to a closed position with the switch contact disabled.

BRIEF DESCRIPTION OF DRAWINGS

A preferred embodiment of the present invention will now be described with reference to the accompanying drawings in which:

FIG. 5 is a further example of the switch actuation means to enable the program circuit;

FIG. 6 is an enlarged view showing the construction of the switch actuation means and its operation; and FIG. 7 is a simplified view similar to FIG. 6 but showing the pair of panels further separated and the position of the switch actuation means.

DESCRIPTION OF PREFERRED EMBODIMENTS

Figure 1:
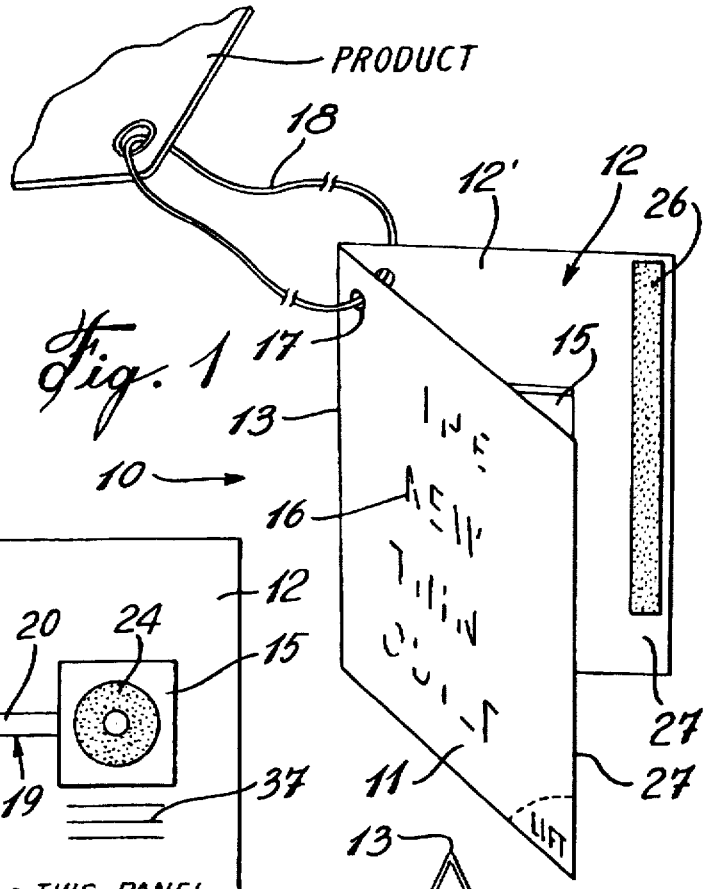
FIG. 1 is a perspective view of the audible product information tag of the present invention.

Referring now to the drawings, and more particularly to FIG. 1, there is shown generally at 10 the audible product information tag of the present invention. As hereinshown, the tag comprises a pair of panels, herein a front panel 11 and a back panel 12 secured together along a fold line 13. An electronic program circuit 14 (see FIG. 4) is located within a wafer-like housing 15 which is herein shown as secured to the inner face 12' of the back panel 12 by suitable fastening means, such as glue (not shown). Identification information 16 about a product to be identified is printed on the front panel. As also hereinshown holes 17 are punched through both panels 11 and 12 whereby to affix to the information tag an attachment means, such as the looped string 18, whereby to attach the tag to a product to be identified. As hereinshown the pair of panels form a card and it is conceivable that this card could have more than two panels and also more than one electronic program circuit secured between adjacent ones of these panels.

Figure 2:
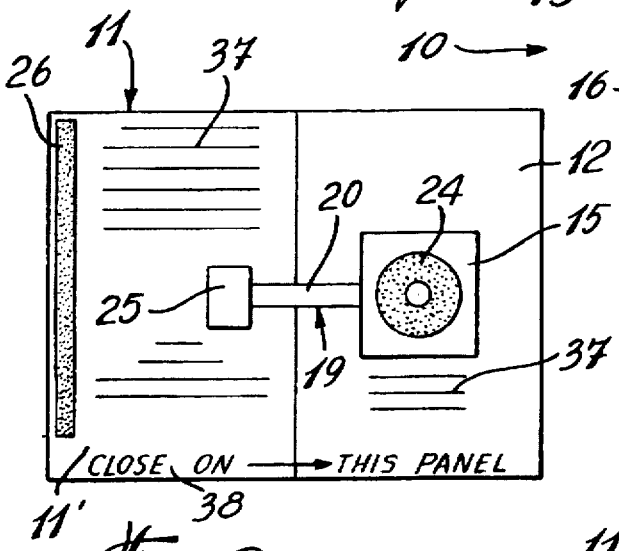
FIG. 2 is a plan view of the audible product information tag in its completely open condition.
Figure 3:
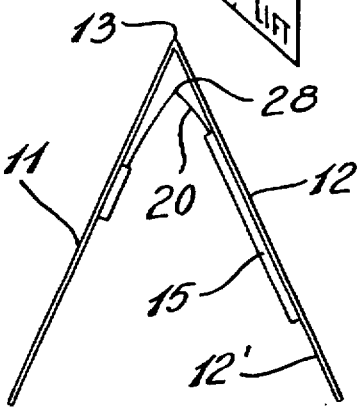
FIG. 3 is a top view showing the information tag partly open and in the process of actuating the electronic program circuit.
Figure 4:
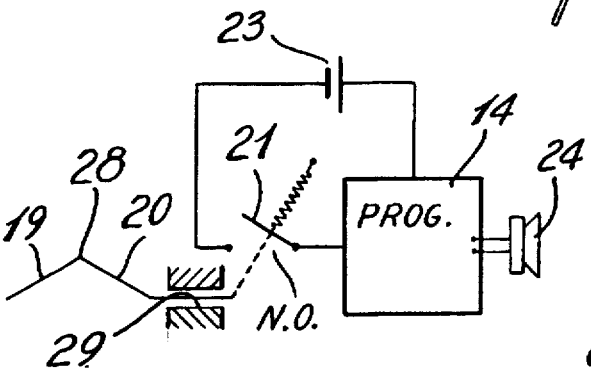
FIG. 4 is a schematic diagram showing how the program circuit is actuated by separating the panels of the tag along a fold line.

Referring now additionally to FIGS. 2 to 4, it can be seen that the electronic program circuit 14 which is housed in the housing 15 is actuatable by a switch actuation means 19. As hereinshown, the switch actuation means is provided by a thin flexible strip member, hereinshown as a thin strip of plastics material which defines a finger portion 20 which extends into the housing 15 to connect to a switch contact 21 of a normally open switch 22. When the finger portion 20 is drawn outwardly by displacing the front panel, it causes the switch contact 21 to close and thereby connect the battery 23 to the electronic program circuit 14 to actuate the circuit whereby an audible message may be transmitted via the speaker 24. The message contains certain characteristics of the product or instructions on how to assemble the product or else important warnings relating to the product, or other information.

As also shown in FIG. 2, the switch actuation means 19 is also secured to the rear surface 11' of the front panel 11 by an attachment tab 25 which is glued to the surface 11' or otherwise attached thereto.

As shown in FIGS. 1 and 2, the inner face of the front panel 11 or the back panel 12 is provided with an engageable detachment means in the form of a detachable and re-engageable adhesive strip 26 disposed adjacent a free end edge 27 of the front or rear panels. This adhesive is of the type utilized on commonly used note pads wherein a note sheet is detachable from the top of a pad and re-attached on any other paper product. Accordingly, by folding the front and back panels together and applying slight pressure along the edge, the product information tag will remain shut whereby not drain the battery 23 after the message has been transmitted by the program circuit.

In order to further prevent the battery from being drained, it can be seen from FIG. 3 that the switch actuation strip 19, which is preformed of plastics material and has a V-like shape with a weakened transverse section 28 to act as a hinge. This V-like shape retains the panels, when separated, to assume a position wherein the switch is not actuated. It is therefore necessary to apply a force to separate the panels and stretch the V-like strip to actuate the switch. FIG. 6 illustrates the alignment of the hinge 28 with the fold line 13 of the card whereby the switch actuation means will always fold inwardly towards the fold line 13 when the open pressure on the panels is released. In order to actuate the switch contact 21 it is necessary to separate the panels 11 and 12 a predetermined distance whereby the strip or switch actuation means will stretch out and exert a pulling force to pull the finger portion 20 slightly out of the housing 15 to perform the switch actuation. It is also pointed out that the finger portion 20 is displaceable within the housing 15 within a confined passage 29, as shown in FIGS. 4 and 5. When the panels are separated this predetermined distance, it urges the contact 21 of the switch 22 to a closed position. When the panels are folded within the predetermined distance, then the switch contact will open to disable the program circuit.

Referring now to FIG. 5, there is shown another example of the construction of the switch actuation means. As hereinshown, the finger portion 20 of the strip-like member 19 is constructed of plastic material which is a non-conductive material and therefore has a non-conductive face portion facing towards the pair of contacts 31 and 32 of a switch 33 formed by these contacts and by an electrically conductive strip 34 which is adhesively secured on the non-conductive face portion 30 of the finger portion 20 which moves in and out of the confinement passage 29. When the front panel 11 is separated to the said predetermined distance, it will draw the conductive member 34 whereby it will engage both switch contacts 31 and 32 thereby causing a switch closure and connecting the battery 23 to the electronic program circuit 14 to enable it to transmit a message via the speaker 24. When the panels are shut a predetermined distance, it will cause the conductive member to disengage with the contact 32 and disconnect the battery from the program circuit.

Summarizing the operation of the audible information tag, it can be seen from FIG. 6 that when the panels are detached and separated as indicated by arrows 35, the preformed switch actuating plastic strip 29 will begin to stretch to a condition as shown in FIG. 7 with the finger portion 20 moving out of the housing as indicated by arrow 36 sufficiently to cause a switch closure to connect a power cell or battery 23 to a programmed circuit 14 to transmit a message to the user. By reclosing the panels 11 and 12 the switch is disabled and the battery is disconnected from the circuit. The tag may be reclosed completely by pressing the outer edges of the panels together whereby the adhesive strip will hold the panels closed. However, because the plastic strip or switch actuation means is preformed, it will maintain the panels 11 and 12 in a condition, as shown in FIG. 3, which is slightly opened but within the predetermined distance and the switch is maintained in a disabled condition. Accordingly, it is not essential to maintain the card in a completely closed condition to disable the program circuit but it is only upon separating the panels beyond a predetermined distance that the program circuit will be reactuatable. As also shown in FIG. 2, the panels may also contain printed instructions 37 thereon giving instructions or characteristics of a product which the tag is to be attached to and may also contain instructions 38 to advise the user to close the card after use.

It is within the ambit of the present invention to cover any obvious modifications of the preferred embodiment described herein, provided such modifications fall within the scope of the appended claims.

I claim:

1. An audible product information tag for attachment to a remote product, said tag comprising a card having a pair of panels folded one over the other along a fold line, an electronic program circuit located in a housing secured to an inner face of one of said panels, switch actuation means connected at one end to an inner face of the other of said panels, said switch actuation means having switch contact operating means at an opposed end for enabling and disabling said electronic program circuit, said switch actuation means being a thin flexible strip-like member having a finger portion, said flexible member being glued at said one end to said inner face of said other of said panels, said switch contact operating means being a connection between said finger portion of said flexible member and a normally open contact of a switch, means urging said contact to a normally open position, said finger portion being displaceable in a confined passage of said housing, said strip-like member having a weakened transverse section to act as a hinge, said transverse section being aligned with said fold line, audible speaker means for transmitting an audible message relating to characteristics of said remote product to which said tag is attached when said open contact of said switch is enabled by said switch actuation means upon displacement of said other of said panels a predetermined distance away from said one of said panels towards an open position, engageable detachment means to maintain said panels folded one over the other to a closed position with said switch contact disabled, said engageable detachment means being a detachable and re-engageable adhesive secured on an inner face of one of said panels adjacent a free end edge thereof to permit several opening and retention closures of said card, said other of said panels being a front panel of said card identifying a product, printed messages on said inner face of said front panel, said card having means to attach same to said remote product, said message or printed matter on said inner face of said front panel contains instructions to instruct a user person to reclose said card with said panels juxtaposed and secured by said adhesive after use, said means to attach including an attaching element secured through a hole formed in a corner of said card adjacent said fold line for attaching said card to said remote product.

2. An audible product information tag as claimed in claim 1 wherein said strip-like member has at least a non-conductive face portion, said switch having a normally closed contact positioned adjacent said face portion, an electrically conductive member secured to said face portion and in frictional contact with said normally closed contact when said other of said panels is not displaced to or beyond said predetermined distance, said electrically conductive member bridging said normally open and normally closed contacts when said other of said panels is displaced on said fold line beyond said predetermined distance.

3. An audible product information tag as claimed in claim 1 wherein said adhesive is an elongated adhesive strip disposed along at least a portion of said free edge.

* * * * *